US006526889B2

(12) United States Patent
Tokiwa

(10) Patent No.: US 6,526,889 B2
(45) Date of Patent: Mar. 4, 2003

(54) SYSTEM AND METHOD FOR SYNCHRONOUS CONTROL OF ROTARY PRESSES

(75) Inventor: Shizurou Tokiwa, Zushi (JP)

(73) Assignee: Tokyo Kikai Seisakusho, Ltd. (JP)

( * ) Notice: Subject to any disclaimer, the term of this patent is extended or adjusted under 35 U.S.C. 154(b) by 286 days.

(21) Appl. No.: 09/745,131

(22) Filed: Dec. 20, 2000

(65) Prior Publication Data

US 2001/0018872 A1 Sep. 6, 2001

(30) Foreign Application Priority Data

Dec. 21, 1999 (JP) ..... 11-362923

(51) Int. Cl.[7] ..... B41F 13/24
(52) U.S. Cl. ..... 101/485; 101/248; 101/227
(58) Field of Search ..... 101/483, 485, 101/486, 227–228, 248, 216, 219, 137, 181

(56) References Cited

U.S. PATENT DOCUMENTS 4,690,051 A * 9/1987 Kishine et al. ..... 101/181
4,719,855 A * 1/1988 Cannon et al. ..... 101/228
4,898,094 A * 2/1990 Doumoto et al. ..... 101/485
5,289,770 A * 3/1994 Hern ..... 101/248
5,436,844 A 7/1995 Tokiwa
5,458,062 A * 10/1995 Goldberg et al. ..... 101/485
5,617,788 A * 4/1997 Horiguchi et al. ..... 101/181
5,699,735 A * 12/1997 Stein et al. ..... 101/219
5,813,333 A * 9/1998 Ohno ..... 101/486
5,970,870 A * 10/1999 Sihza et al. ..... 101/137
6,321,650 B1 * 11/2001 Ogawa et al. ..... 101/227
6,360,665 B1 * 3/2002 Hartmann et al. ..... 101/483

FOREIGN PATENT DOCUMENTS

| | | |
|---|---|---|
| DE | 42 14 394 | 11/1993 |
| EP | 0 816 963 | 1/1998 |
| JP | Hei-6(1993)-64882 | 3/1993 |
| JP | Hei-6(1994)-47905 | 2/1994 |
| JP | Hei-10(1998)-114058 | 5/1998 |
| WO | WO 97/11848 | 4/1997 |

* cited by examiner

*Primary Examiner*—Eugene H. Eickholt
(74) *Attorney, Agent, or Firm*—McGlew and Tuttle, P.C.

(57) ABSTRACT

A rotary printing press control method receiving a drive reference from a master control section, generating a phase correction based on dividing a length between a printing unit and a folding unit by an outer peripheral length of a printing cylinder of the printing unit, generating a drive reference speed signal based on the drive reference, generating a corrected drive reference phase signal obtained by correcting a drive reference phase based on the drive reference with the phase correction, generating a feedback speed signal and a feedback phase signal based on the operating condition of the printing unit, generating a phase difference signal based on a phase difference between the corrected drive reference phase and the feedback phase signal, and correcting the drive reference speed signal and the feedback speed signal to control a drive for the printing unit.

20 Claims, 8 Drawing Sheets

CONTROL MESSAGE
STX
PCM
1
11
12
13
14
15
16
21
22
23
31
32
33
34
41
42
53
54
99
8
7
6
5
4
3
2
1
XTEB
CCCC

SYSTEM AND METHOD FOR SYNCHRONOUS CONTROL OF ROTARY PRESSES

BACKGROUND OF THE INVENTION

1. Field of the Invention

The present invention relates generally to a system and method for synchronous control of rotary printing presses, and more particularly to a system and method for synchronous control of rotary printing presses comprising a plurality of printing units, a folding unit for cutting and folding a printed paper web into predetermined printed images; drive means for independently driving the units, and control sections for controlling the drive means for the printing units being provided on each of the units; and at least one printing unit having a plurality of web paths running from the printing unit in question to the folding unit, in which the position at which the paper web is cut by the folding unit in accordance with the printed images printed by the printing unit can be automatically adjusted for each web path selected.

2. Description of the Prior Art

A newspaper press is well known as a rotary printing press having a plurality of printing units and a folding unit for cutting and folding a printed paper web into predetermined printed images. A rotary press in which printing and folding units are individually driven by independent electric motors and the control of the operation thereof are known by Japanese Published, Unexamined Patent Application No. Hei-6(1994)-47905, for example.

Disclosed in Japanese Published, Unexamined Patent Application No. Hei-6(1994)-47905 is a rotary press having individual driving sections (electric motors) for driving driven parts (cylinders) of printing units, and drive control devices for the individual driving sections as printing station groups. Several printing station groups are independent from each other and receive their respective positional references via a data bus on which the printing stations are disposed. That is, the printing station group have their respective drive units, which are connected to a data bus to which a folding unit is connected, and to the drive control devices for the printing station groups. The drive unit controls the positioning of the individual driving sections of the printing station groups in connection with the positional reference received from the folding unit, and also controls the relative positions of the individual drive sections.

An operation and data processing unit as a host master unit is connected to the data bus to which the drive unit is connected. The operation and data processing unit controls the printing station groups. That is, the operation and data processing unit presets target values and a target value difference, and processes actual value, so that the target-value control of different printing station groups can be accomplished consistently among the printing station groups and to the folding unit.

In other words, this rotary press is such that the drive control of the electric motors of the printing station groups is accomplished with respect to the positional reference received from the folding unit based on the control reference from the drive unit and the host master unit via the drive control device.

In a newspaper press, on the other hand, a bay window device BW for changing the top and bottom of a printed paper web with a combination of bay window rollers BR and BR as shown in FIG. 5, for example, with turn bars TB and TB is provided to adjust the arrangement of multi-color printing units and pages on which multiple-color images are to be printed, and a plurality of web paths for feeding the paper web on which images were printed by a printing unit CT to the folding unit FD.

In a rotary press the overall picture of which is shown by combining the right side of FIG. 3 with the left side of FIG. 4, a paper web on which images were printed by a printing unit CT1 is passed through web paths SP1 and SP5 leading to a folding unit FD bypassing a bay window device BW and web paths BP2, BP3, BP4 and BP5 from turn bars TB2, TB3, TB4 and TB5 on each stage to the folding unit FD via the bay window device BW, while each of other printing units CT2, CT3, CT4 and CT5 has web paths leading to the folding unit bypassing the bay window device BW and web paths from the turn bar TB of each stage to the folding unit FD via the bay window device BW.

In such a rotary press, where a plurality of web paths leading from a given printing unit to the folding unit have different lengths, an adjust roller device AD (refer to FIG. 5) is provided, as shown in Japanese Published Examined Patent Application No. Hei-7(1995)-17054, to allow the length of the web path to be adjusted by moving an adjust roller AR (refer to FIG. 5) of the adjust roller device AD, on which the paper web has been wound about 180 degree, to a predetermined position in parallel with the paper web at a preset value, so that any paper web that has been passed through any web path can be cut into printed images at the right position by the folding unit.

The aforementioned Japanese Published Unexamined Patent Application No. Hei-6(1994)-47905, however, discloses the construction and operation of the invention only schematically, and does not disclose any specific details of control.

As to how to control the positioning of the individual drive sections for the printing station groups, and how to control the relative positioning of the individual drive sections with each other, in connection with the positional references received from the folding unit, Japanese Published Unexamined Patent Application No. Hei-6(1994) 47905 has no specific description about how to control what. Even assuming that this control is concerned with the control to properly adjust the relations among printed images and between printed images and cutting and folding, it has no specific description about how to achieve the control. It does not disclose, furthermore, that the control is concerned with a rotary press comprising printing units having a plurality of web paths, as mentioned earlier.

In a rotary press, on the other hand, an adjust roller device AD has usually been provided in front of the folding unit for each web path, as described above, to adjust so that the paper web can be cut by the folding unit at proper positions in accordance with printed images. This arrangement has involved a considerable space because the adjust roller device AD is provided for each web path, and made maintenance difficult as web paths have been increased in number and more and more complicated. Since the paper web runs through the adjust roller device AD during printing operation, unwanted tension is likely to be caused, making the travel of the paper web unstable and increasing the length of the web paths by the amount of travel via the adjust roller device AD. Thus, this arrangement has involved increased spoilage during paper web changing, at the start and end of printing. Furthermore, provision of the adjust roller devices AD has involved increased manufacturing cost.

SUMMARY OF THE INVENTION

It is an object of the present invention to provide a synchronous control system for rotary presses having a plurality of web paths in which the position at which the paper web is cut by the folding unit can be automatically adjusted in accordance with printed images for each selected web paths without using the adjust roller devices.

It is another object of the present invention to provide printing units each having at least one of a plurality of web paths leading to the folding unit, going through, or without going through bay window devices.

It is a further object of the present invention to provide printing unit control sections for receiving drive references, including drive reference speed and drive reference phase transmitted by the master control section.

It is still a further object of the present invention to provide a loop-like network line to allow a failed part of the network line to be bypassed.

It is still a further object of the present invention to provide a master control section that performs information exchange with printing unit control sections, so that the positions at which the paper web is cut by the folding unit in accordance with printed images can be automatically adjusted for each selected web path.

It is still a further object of the present invention to provide an input operation section for storing in the memory section the length value of each web path from the printing unit to the folding unit.

It is still a further object of the present invention to provide a control message and the construction thereof for designating the control range of rotary press sets organized by the processing section, and control messages and the construction thereof relating to drive references, such as drive reference speed and phase, and phase correction values for correcting the rotational phase of the printing cylinder.

It is an even further object of the present invention to provide the construction of a response message sent by the slave control section.

It is an even further object of the present invention to provide a synchronous control system for rotary presses in which even when a master control section fails, the positions at which the paper web is cut by the folding unit in accordance with printed images can be automatically adjusted for each selected web path by selectively changing over by another master control section.

It is an even further object of the present invention to provide a method for synchronous control of rotary presses having a plurality of web paths in which the positions at which the paper web is cut by the folding unit in accordance with printed images can be automatically adjusted for each selected web path without using adjust roll devices.

In disclosed embodiments, a synchronous control system for rotary presses having a master control section for controlling the entire system, drive means provided in a plurality of printing units and a folding unit that cuts and folds a printed paper web in accordance with printed images for independently driving the units, control sections for controlling the drive means of each unit; at least one printing unit having a plurality of web paths running from the printing unit to the folding unit through which the paper web is passed for printing, has such a construction that the printing unit control section having a plurality of web paths comprises a drive reference receiving section for receiving a drive reference from the master control section, a phase correction value output section for generating a phase correction value based on the length from the printing unit in question to the folding unit in a selected web path, a drive reference speed signal output section for generating a signal relating to drive reference speed based on the drive reference receiving by the drive reference receiving section, a corrected drive reference phase signal output section for generating a signal relating to the corrected drive reference phase obtained by correcting the drive reference phase based on the drive reference received by the drive reference receiving section with the aforementioned phase correction value, a feedback signal receiving section for receiving a feedback signal on the operating condition of the printing unit in question, a feedback speed signal output section for generating a signal relating to feedback speed based on the feedback signal received by the feedback signal receiving section, a feedback phase signal output section for generating a signal relating to the feedback phase based on the feedback signal received by the feedback signal receiving section, a phase difference detecting section for detecting a phase difference between the corrected drive reference phase and the feedback phase from the corrected drive reference phase signal and the feedback phase signal, a phase difference signal output section for generating a signal relating to the phase difference detected by the phase difference detecting section, and a signal correcting section for correcting the aforementioned drive reference speed signal based on the phase difference signal and the feedback speed signal relating to the phase difference between the aforementioned corrected drive reference phase and the feedback phase and generating a corrected control signal.

DETAILED DESCRIPTION OF PREFERRED EMBODIMENTS

Figure 3:
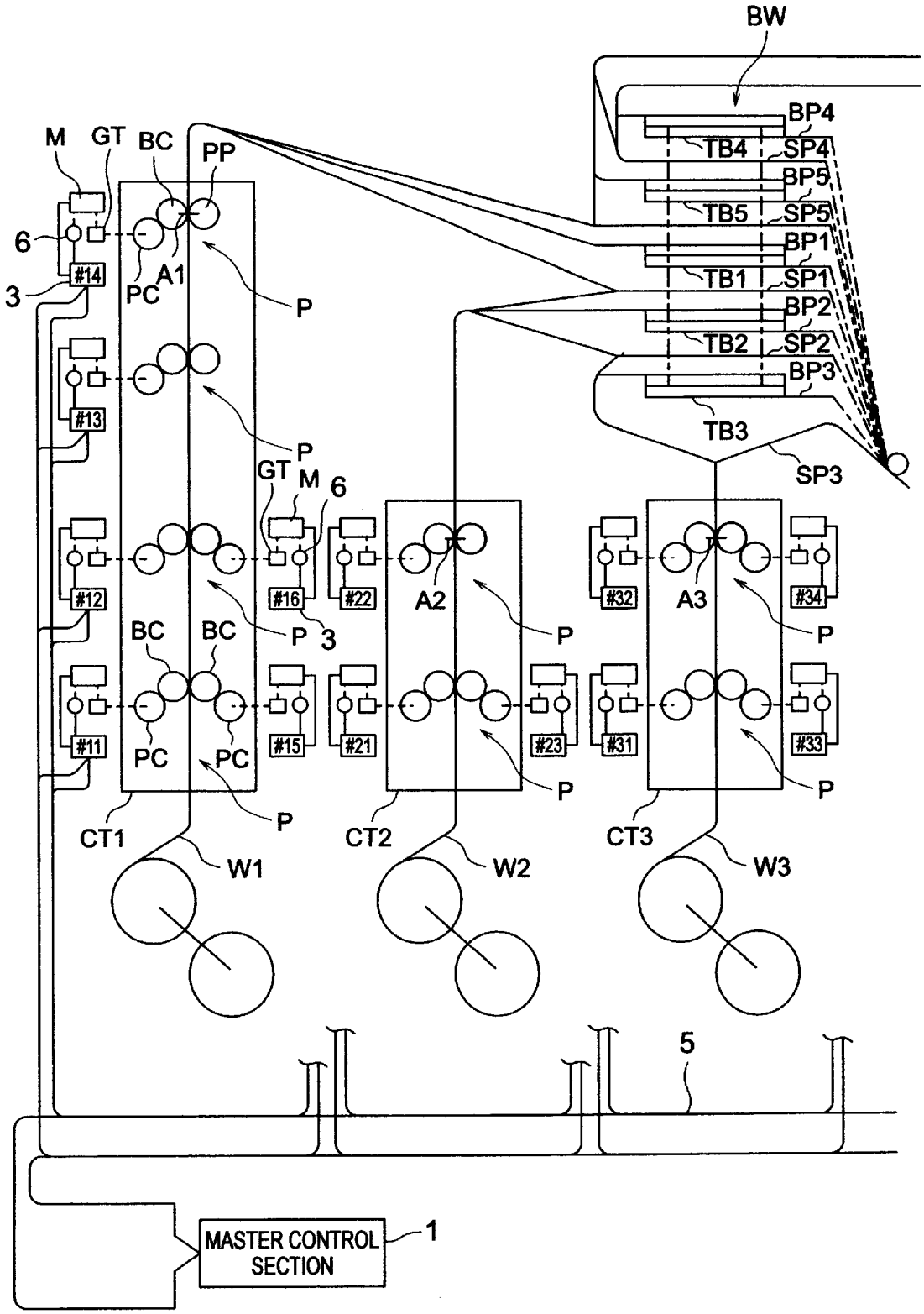
FIG. 3 is a part of a schematic diagram illustrating an example of a rotary press in which a synchronous control system for rotary presses according to the present invention is used.
Figure 4:
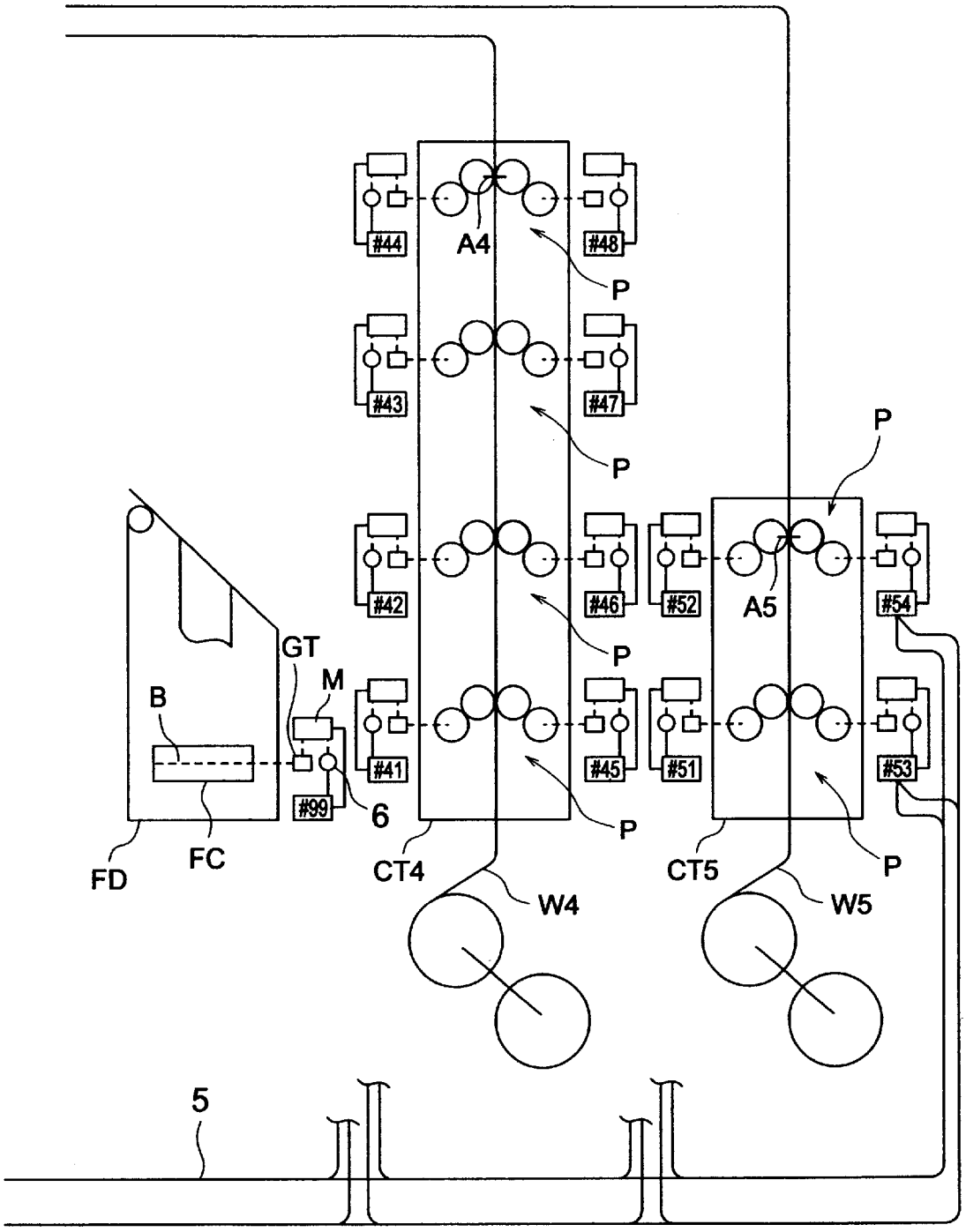
FIG. 4 is another part of a schematic diagram illustrating an example of a rotary press in which a synchronous control system for rotary presses according to the present invention is used, the left end of which is connected to the right end of FIG. 3 to form an entire view.
Figure 5:
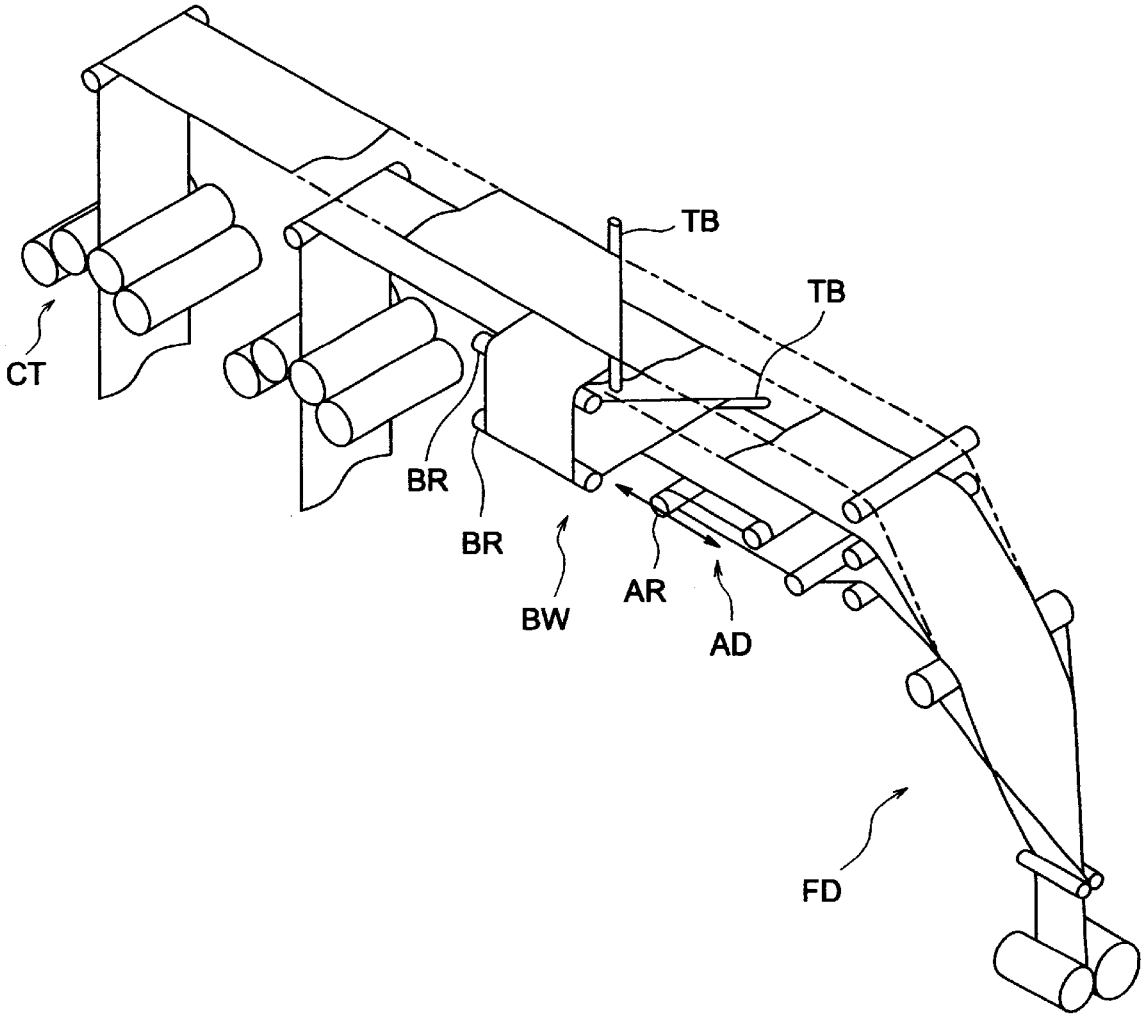
FIG. 5 is a schematic perspective view of assistance in explaining the function of a bay window device.

FIG. 3 is a part of a block diagram showing an example of a rotary press in which a synchronous control system for rotary presses according to the present invention is used. FIG. 4 is another part of a block diagram showing an example of a rotary press in which a synchronous control system for rotary presses according to the present invention is used, the left end of which is connected to the right end of FIG. 3 to form an entire view.

Shown in full view by combining FIGS. 3 and 4 is an embodiment in which a synchronous control system for rotary presses according to the present invention is used in a rotary press comprising printing units CT1 and CT4 each having four printing sections P, printing units CT2, CT3 and CT5 each having two printing sections P, and a folding unit FD for cutting and folding a printed paper web into predetermined printed images.

Each of the printing units CT1, CT2, CT3, CT4 and CT5 has at least one of web paths SP1, SP2, SP3, SP4 and SP5 running from the printing units CT1, CT2, CT3, CT4 and CT5 to the folding unit FD via the bay window device BW, and at least one of web paths BP1, BP2, BP3, BP4 and BP5 running from any of the turn bars TB1, TB2, TB3, TB4 and TB5 to the folding unit FD via the bay window device BW.

Each printing section P of the printing units CT1, CT2, CT3, CT4 and CT5 has two sets of printing couples consisting of a blanket cylinder BC and a plate cylinder PC, except that the third-stage and fourth-stage printing sections P of the printing unit CT1 and the second-stage printing section P of the printing unit CT2 each comprise a printing couple consisting of a blanket cylinder BC and a plate cylinder PC, and a pressure cylinder PP.

Each printing couple is such that the plate cylinder PC thereof is driven by the drive means M via a transmission means GT, and the blanket cylinder BC thereof is driven by a drive means M via a transmission means (not shown) provided between the plate cylinder PC and the blanket cylinder BC. The pressure cylinder PP is driven by the blanket cylinder BC via a transmission means (not shown) provided between the blanket cylinder BC and the pressure cylinder PP.

That is, each of the printing units CT1, CT2, CT3, CT4 and CT5 is driven by an independent drive means M. The folding unit FD is such that the folding cylinder FC thereof (not shown) is driven by a drive means M via a transmission means GT, and the other cylinder thereof is driven by the drive means M via a transmission means (not shown) provided between the folding cylinder FC and the other cylinder. There can be a construction where the output shaft of the drive means M directly drives the plate cylinder PC or the folding cylinder FC, except for the transmission means GT provided between the drive means M and the plate cylinder PC or the folding cylinder FC.

The drive means M have #11~#16, #21~#23, #31~#34, #41~#48, #51~#54, and #99 of slave control sections 3 corresponding to each drive means M, and rotary encoders with Z phase 6 (hereinafter referred to as an encoder for short) for generating a Z-phase pulse signal at every revolution. The slave control section 3 is connected to the network line 5 via a slave network connecting section 31, which will be described referring to FIG.1. (The state of connection of the slave control sections 3 of #15~#16, #21~#23, #31~#34, #41~#48, #51~#52, and #99 with the network line 5, which is the same as that of the slave control sections 3 of #11~#14, #53~#54, is omitted in the figure.) A master control section 1 is connected to the network line 5. There can be a construction where a plurality of master control sections each having functions of the master control section, which will be described in the following, are provided in place of the master control section 1 and used by selectively changing them.

The network line 5 is constructed into a loop shape so that even when any one part of the network line 5 fails due to some trouble, signal transmission between the master control section 1 and the slave control sections 3 of#11~#16, #21~#23, #31~#34, #41~#48, #51~#54, and #99 can be maintained by the other part of the line.

Figure 2:
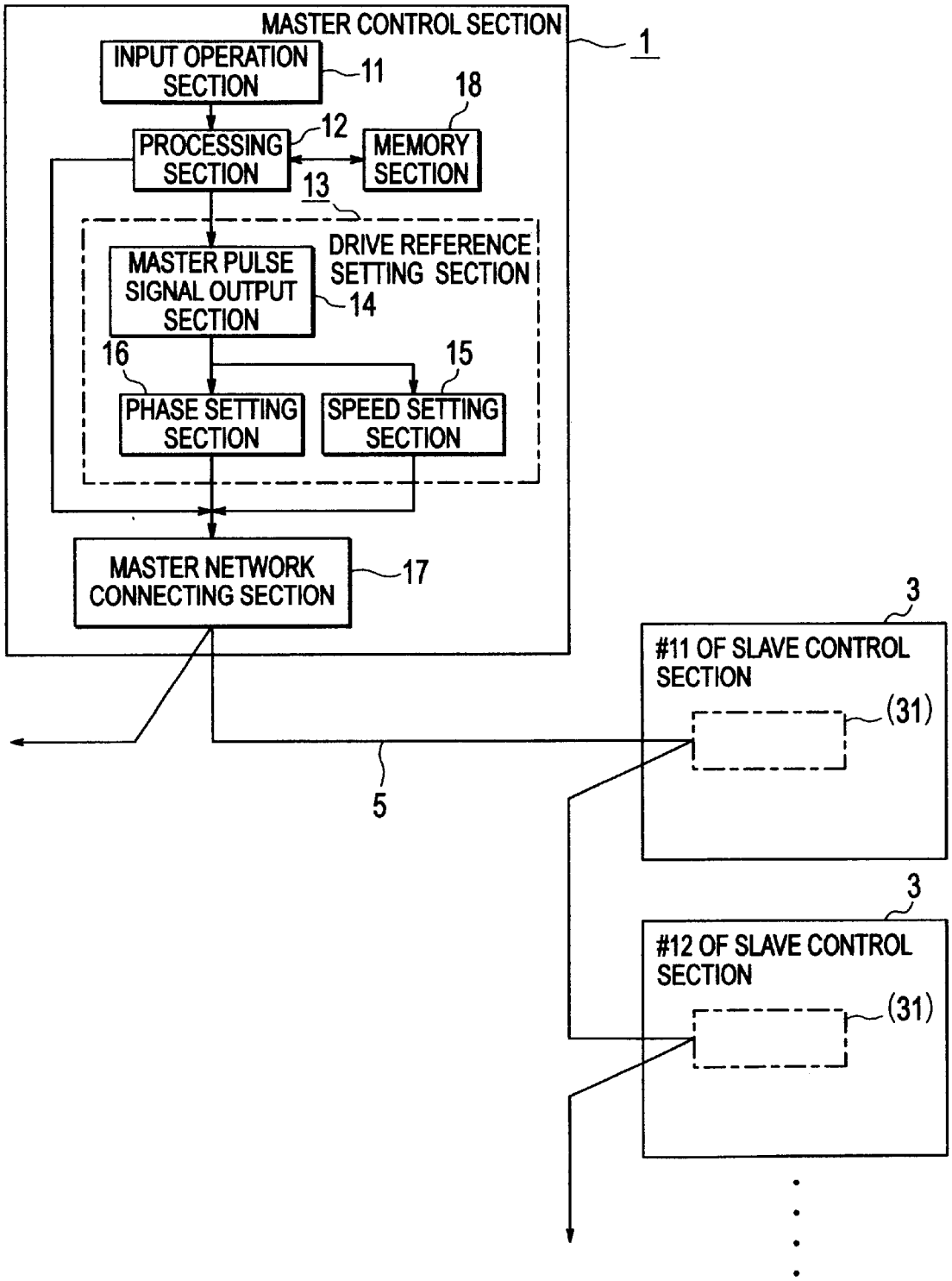
FIG. 2 is a block diagram illustrating an example of the master control section.

FIG. 2 shows an example of the master control section 1.

In the figure, the master control section 1 comprises an input operation section 11, a drive reference setting section 13, a processing section 12, a master network connecting section 17, and a memory section 18.

The input operation section 11 is capable of entering into the memory section 18 the values of lengths between the printing units CT1, CT2, CT3, CT4 and CT5 in each web path and the folding unit FD, that is, the values of the web path lengths, and also capable of executing initial operations to enter information on set organization, such as designation of printing units CT1, CT2, CT3, CT4 and CT5 to be used during printing, and actual printing operations to enter operation signals, such as the start, acceleration and deceleration, and stop of the press.

The memory section 18 stores the values of web path lengths entered by the input operation section 11, and phase correction values for correcting the phases of the driven parts of the printing units in relation to the web path length values. The driving reference setting section 13 sets the driving reference values for controlling the driving means M.

The processing section 12 prepares a control range designating message and other messages by organizing rotary press sets on the basis of the set organization information entered by the input operation section 11, and makes it possible to carry out operations from the input operation section 11 so that the organized sets can be synchronous controlled, and set drive references based on the operations. The processing section 12 also reads the web path length values from the memory section 18, and calculates the phase correction value for correcting the rotating phase of the printing cylinder, or the plate cylinder PC in this embodiment, of each printing unit so as to match the rotating phase of the plate cylinder PC with that of the folding cylinder FC of the folding unit, and stores the calculated phase correction value in the memory section 18 and reads it from the memory section 18.

The master network connecting section 17 transmits a control range designation message prepared by the processing section 12 to the network line 5, and control messages relating to the phase correction value read from the memory section 18 and the driving reference set by the drive reference setting section 13 to the network line 5, and receives a response message that is response information transmitted by the slave control section 3 to the network line 5.

The driving reference setting section 13 has a master pulse signal output section 14, a speed setting section 15, and a phase setting section 16.

The master pulse signal output section 14 generates a first master pulse signal proportional to the speed value set by the processing section 12 on the basis of the operation signal, such as the start, acceleration/deceleration and stop of the press, entered by the input operation section 11, and generates a second master signal every time a predetermined number of the first master pulse signals are output. The first and second master pulse signals are signals having a frequency equal to that of the pulse signal generated by the encoder 6 provided corresponding to each driving means M and to that of the Z-phase pulse signal generated by the encoder 6 when the printing unit is operated at a predetermined speed.

The speed setting section 15 sets the driving reference speed of the driving means M on the basis of the first master pulse signal generated by the master pulse signal output section 14.

The phase setting section 16 sets the driving reference phase of the printing cylinder to be driven by the driving means M on the basis of the first and second master pulse signals generated by the master pulse signal output section 14.

The master control section 1 can have such a construction that it comprises an input operation section capable of executing initial operations to enter information on set organization, and printing operations to enter operation signals, such as the start, acceleration and deceleration, and stop of the press, a processing section for setting speed values on the basis of operation signals, and master pulse signal output section that generates a first master pulse signal proportional to the speed value, and a second master signal every time a predetermined number of the first master pulse signals are output; the remaining component elements included in a slave control section, which will be described later. In this construction, set organization information can be entered directly from the input operation section to each slave control section included in the sets. The master control section 1 may be of such a simplified construction that oscillators for sending synchronizing clock (drive reference) are provided in each unit and the slave control section thereof. In short, the master control section 1 may be of such a simple construction that it can send signals sufficient for each printing unit, etc. to be synchronously controlled by each slave control section, as will be described later.

Figure 1:
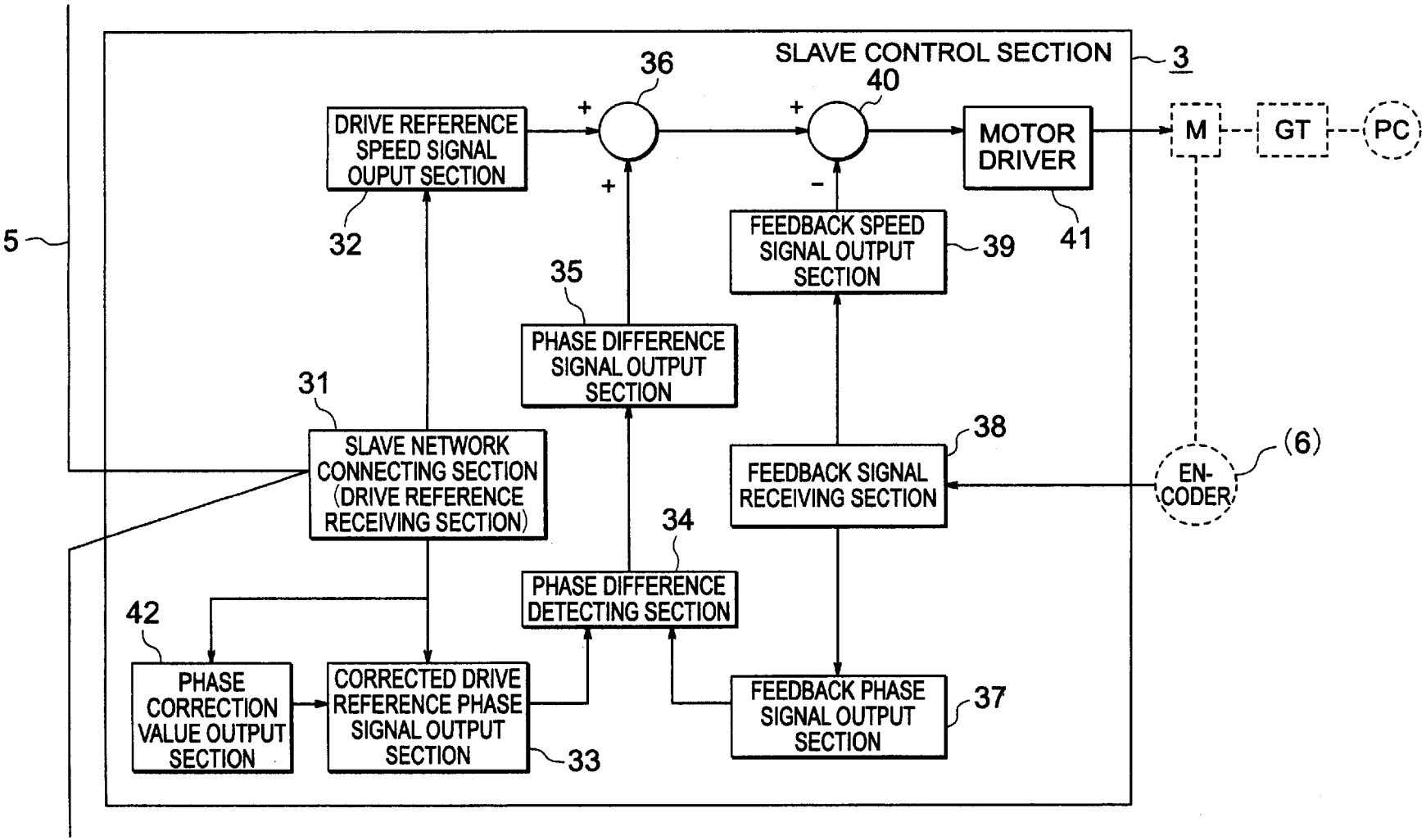
FIG. 1 is a block diagram illustrating an example of the slave control section.

FIG. 1 shows an example of the slave control section.

In the figure, the slave control section 3 comprises a slave network connecting section 31 that also serves as a drive reference receiving section, a phase correction value output section 42, a drive reference speed signal output section 32, a corrected drive reference phase signal output section 33, a feedback signal receiving section 38, a feedback speed signal output section 39, a feedback phase signal output section 37, a phase difference detecting section 34, a phase difference signal output section 35, a first speed signal correcting section 36, a second speed signal correcting section 40, and a motor driver 41.

The slave network connecting section 31, which is a microcomputer including an interface, receives via the network line 5 a control range designating message comprising set organization information transmitted by the master control section 1, and a control message, such as the drive reference, including the drive reference speed and the drive reference phase, and phase correction values for correcting the rotating phase of the printing cylinder, and transmits as necessary a response message acknowledging the receipt of a message from the master control section 1 via the network line 5.

The phase correction value output section 42 registers a phase correction value in a control message received by the slave network connecting section 31, and sends it to the corrected drive reference phase signal output section 33.

The drive reference speed signal output section 32 converts a drive reference speed in a control message into a drive reference speed signal that is an analog signal proportional to the speed value entered by the input operation section 11 and set by the processing section 12, and generates it as an output.

The corrected drive reference phase signal output section 33 receives a drive reference phase value in a control message, and receives a phase correction value registered in the phase correction value output section 42 every time the drive reference phase is received. The corrected drive reference phase signal output section 33 corrects the drive reference phase into a corrected drive reference phase that is a rotating phase of each printing cylinder so that the printed images printed by the printing units CT1, CT2, CT3, CT4 and CT5 in their respective current web paths are maintained in a proper relationship with the positions at which the printed paper web is cut by the folding unit FD, and outputs it in the form of an appropriate signal.

The feedback signal receiving section 38 receives a pulse signal produced by the encoder 6 corresponding to the driving means M and a Z-phase pulse signal. The feedback speed signal output section 39 calculates a value proportional to the rotational speed of the drive means M on the basis of a pulse signal produced by the encoder 6, converts it into a driving speed signal that is an analog signal proportional to the rotating speed of the driving means M, and generates it as an output. The feedback phase signal output section 37 detects the rotating phase of a driving section (for example, the printing cylinder that is a plate cylinder PC) on the basis of the pulse signal generated by the encoder 6, and outputs it in the form of an appropriate signal.

The phase difference detecting section 34 detects a difference between the phase of the printing cylinder and the corrected drive reference phase on the basis of the corrected drive reference phase signal generated by the corrected drive reference phase signal output section 33 and the phase signal of the printing cylinder generated by the feedback phase signal output section 37.

The phase difference signal output section 35 is a proportional-plus-integeral control amplifier for converting the difference detected by the phase difference detecting section 34 into a phase difference signal that is an analog signal, and generates it as an output.

The first speed correcting section 36 corrects the drive reference speed signal generated by the drive reference speed signal output section 32 on the basis of the phase difference signal generated by the phase difference signal output section 35. The second speed correcting section 40 corrects the first corrected speed signal corrected by the first speed correcting section 36 on the basis of the drive speed signal for the driving means M generated by the feedback speed signal output section 39.

The motor driver 41 supplies drive power to the driving means M on the basis of the second corrected speed signal corrected by the second speed signal correcting section 40.

In the printing units CT1, CT2, CT3, CT4 and CT5, the rotating phases of the printing cylinders (the plate cylinders PC, for example) of the printing sections P are determined in advance so that printed images on the printing sections P, - - - are superposed properly with each other when the printing sections P, - - - of the printing units CT1, CT2, CT3, CT4 and CT5 are driven in accordance with the drive reference.

In the following, the operation by the synchronous control system for rotary printing presses will be described.

Prior to the printing operation by the rotary press, the length from the most downstream-side printing positions A1, A2, A3, A4 and A5 (refer to FIGS. 3 and 4) of the printing units CT1, CT2, CT3, CT4 and CT5 to the cutting position of the folding unit FD, that is, the length values L, - - - of the web paths between the printing units and the folding unit are entered from the input operation section 11 for all the web paths of the printing units CT1, CT2, CT3, CT4 and CT5, and stored in the memory section 18.

When the length values L, - - - of the web paths between the printing units and the folding unit are entered, the processing section 12 converts, for each web path based on the length values, the correction value for correcting the drive reference phase of the printing cylinder at the printing position with respect to the drive reference phase of the folding cylinder of the folding unit into an output pulse number of the encoder 6 generated by the rotation of the drive means M so as to maintain a proper relationship between the printed images printed by the printing unit and the positions at which the paper web is cut by the folding unit at the cutting position, using the following equation.

$$Xn=K\times M0\times\{Ln/L0-FIX(Ln/L0)\}$$

where

K: A predetermined number that is determined by the ratio between the revolution of the driven part driven by a drive means M, which will be described later, and the encoder 6

MO: The number of pulses generated by the encoder 6 during one revolution

Ln: The length of a web path between the printing unit and the folding unit (length from An to B)

L0: The outer peripheral length of the blanket cylinder

FIX(Ln/L0): The integer value of Ln/L0

The value Xn obtained by the processing section 12 is stored as a phase correction value entered in the memory section 18.

Next, the information on set organization that designates the printing unit and the folding unit to be synchronously controlled by the master control section 1 during printing operation, and also designates the web path to be used during printing operation is entered from the input operation section 11 of the master control section 1.

In the embodiment shown in full view by combining FIGS. 3 and 4, for example, the set organization information that designates the printing units CT1, CT2, CT3, CT4 and CT5 and the folding unit ED, and sets the operation where synchronous control is carried out by the master control section 1 in such a manner that the paper web W1 passed through the four printing sections P of the printing unit CT1 is threaded through the web path SP5, the paper web W2 passed through the two printing sections P of the printing unit CT2 is threaded through the web path SP1, the paper web W3 passed through the two printing sections P of the printing unit CT3 is threaded through the web path SP2, the paper web W4 passed through the four printing sections P of the printing unit CT4 is threaded through the web path BP3, and the paper web W5 passed through the two printing sections P of the printing unit CT5 is threaded through the web path BP2 is entered into the master control section 1. In this paper web threading mode, the paper webs when threading into the folding unit FD are overlaid in the order of W4, W3, W5, W2 and WI from the bottom.

With this input, the processing section 12 of the master control section 1 transmits a control range designating message comprising ASCII codes to #11~#16, #21 ~#23, #31~#34, #41~#48, #51~#54, and #99 of the slave control sections 3, via the master network connecting section 17 and the network line 5.

Figure 6:
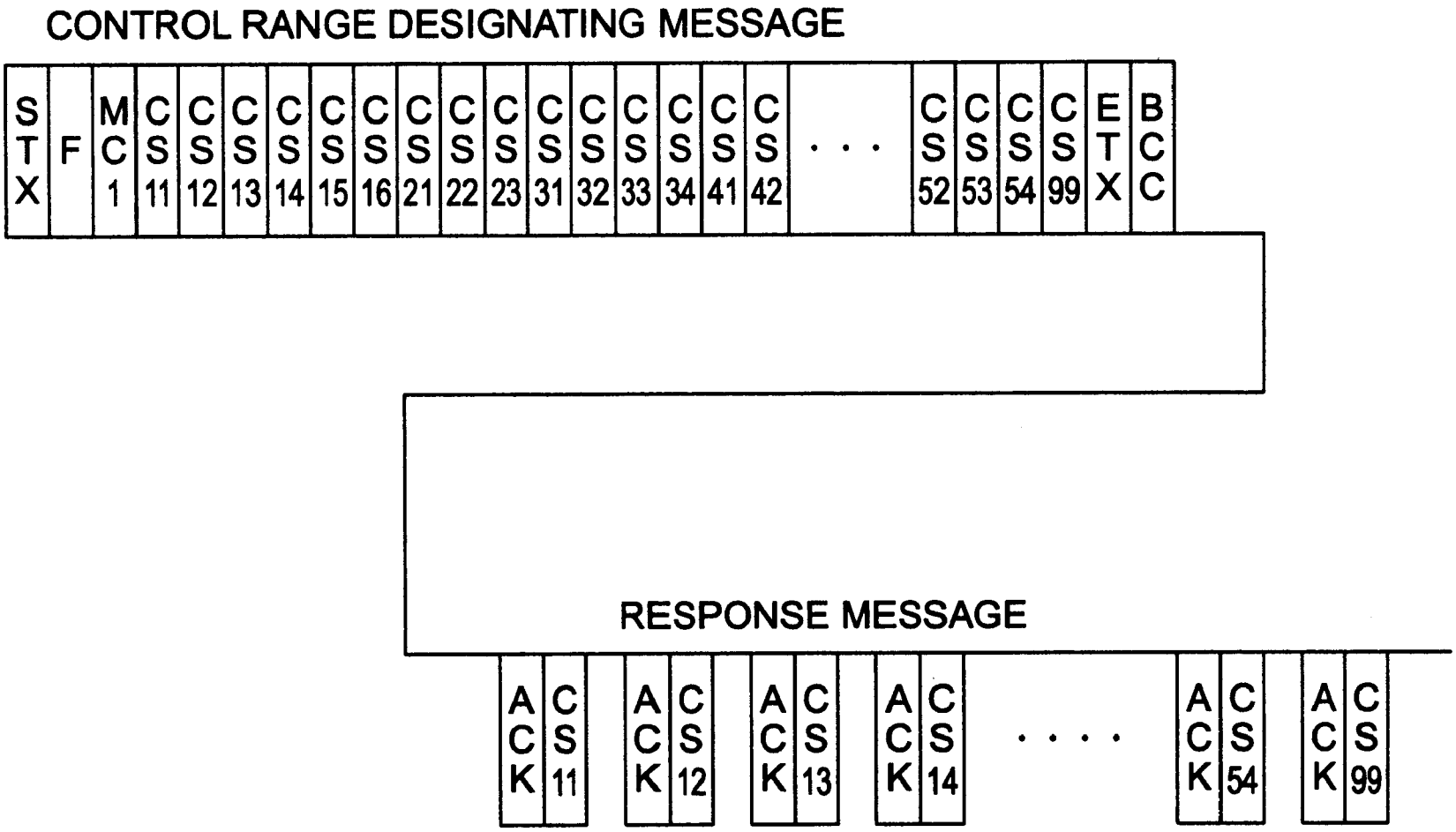
FIG. 6 is a diagram illustrating an example of a message instructing control range transmitted by the master control section and a response message responded to it by the slave control section.

The control range designating message comprises a text in which "F" indicating that the message is to designate the control range, "MCI" representing a master control section 1, "CS11" through "CS54" and "CS99" representing the node numbers of#11~#16, #21~#23, #31~#34, #41~#48, #51~#54 and #99 of the slave control sections 3 for the printing couples that are included in the control range in question are inserted between the start code "STX" and the end code "ETX" of the message, with a block check "BCC" attached to the text, as shown in FIG. 6.

Upon receipt of the control range designating message, the network connecting section 31 of each slave control section 3 returns a response message to the master control section 1 via the network line 5 to acknowledge the receipt of the control range designating message. The response message comprises "ACK" indicating a response message, and its own node number indicating the slave control section 3 that responded.

Next, the processing section 12 reads from the memory section 18 the aforementioned phase correction value for each web path of the printing units, CT1, CT2, CT3, CT4 and CT5 as it is entered, and reduces the read value into a control message comprising ASCII codes, and transmits the control message to #11~#16, #21~#23, #31~#34, #41~#48, #51~#54 of the slave control sections 3 of the printing units CT1, CT2, CT3, CT4 and CT5 via the master network connecting section 17 and the network line 5. Transmission of this control message is carried out sequentially to each slave control section 3 while receiving a response message from the slave control section 3 that is the destination of the control message.

Figure 7:
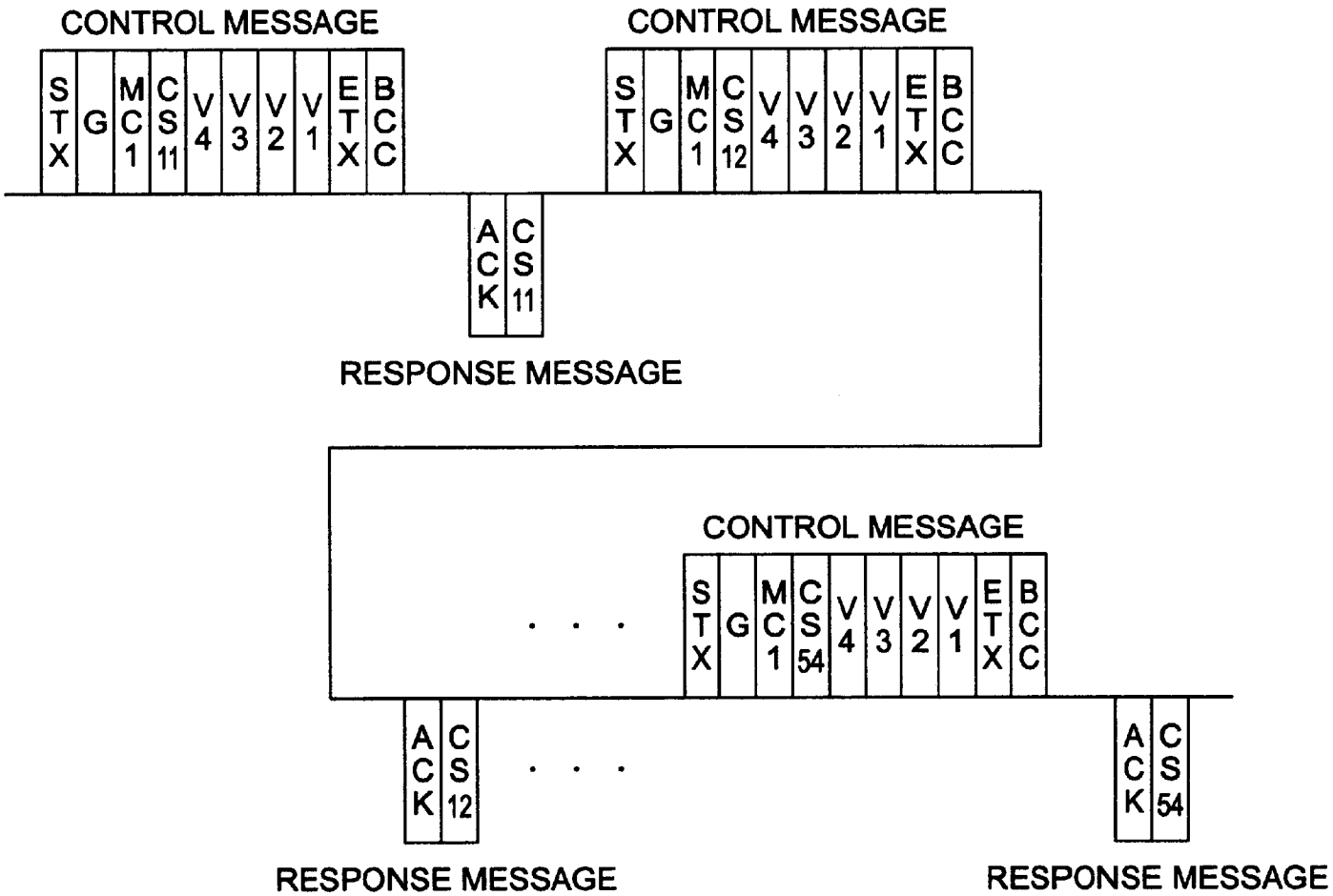
FIG. 7 is a diagram illustrating an example of a control message relating to the phase correction value transmitted by the master control section and a response message responded to it by the slave control section.

That is, this control message comprises a text having "G" indicating that this message is a phase correction value, "MCI" indicating a master control section 1, any of "CS11"~"CS16," "CS21"~"CS23," "CS31"~"CS34," "CS41"~"CS48," and "CS51"~"CS54" indicating destinations, and "V4," "V3," "V2," and "V1" indicating phase correction values, all inserted between the start code "STX" and the end code "ETX" of the message, with a block check "BCC" added to the text sentence, as shown in FIG. 7, for example. It should be noted that "V4" through "V1" use ASCII codes from "0" to "9" and from "A" to "F," and that the phase correction value in the message used here as an example comprises 4bytes, for example. It should also be noted that the same correction value X1 is transmitted to "CS11"~"CS16," the same correction value X2 to "CS21"~"CS23," the same correction value X3 to "CS31"~"CS34," the same correction value X4 to "CS41"~"CS48," and the same correction value X5 to "CS51"~"CS54," respectively. The phase correction values X1, X2, X3, X4 and X5 are usually different from each other.

The slave network connection section 31 of each slave control section 3, to which a control message as a phase correction value is transmitted, returns via the network line 5 a response message acknowledging the receipt of the control message comprising a phase correction value to the master control section 1. This response message comprises "ACK" indicating that it is a response message, and its own node number indicating the slave control section that responded. In this way, control and response messages are sent and received sequentially to each slave control section 3.

The phase correction value sent to the slave control section 3 is registered in the phase correction value output section 42 via the slave network connecting section 31.

These settings enables the master control section 1 to carry out the synchronous control of the rotary press for which set organization has been completed.

Synchronous control is such that the input operation section 11 of the master control section 1 is first switched to the operation signal input enable state, and then start, acceleration/deceleration, stop and other operation signals are entered from the input operation section 11.

As an operation signal is entered, the processing section 12 sets the speed value corresponding to the entered operation signal to the master pulse signal output section 14 of the drive reference setting section 13. This permits the master pulse signal output section 14 to produce a first master pulse signal corresponding to the set speed, and to produce a second master pulse signal every time a predetermined number of the first master pulse signals are produced. The first and second master pulse signals are signals having a frequency equal to that of the pulse signal produced by the encoder 6 provided corresponding to each driving means M and that of the Z-phase pulse signal produced by the encoder 6 when the rotary press is operated at the set speed.

As the master pulse signal output section 14 starts generating the aforementioned signals, the speed setting section 15 and the phase setting section 16 of the drive reference setting section 13 integrate pulse outputs generated by the master pulse signal output section 14. That is, the speed setting section 15 integrates the first master pulse signals, which are cleared by the second pulse signals. The phase setting section 16 integrates the first and second master pulse signals, while the integrated value of the first master pulse signals is cleared by the second master pulse signal, and the integrated value of the second master pulse signals is cleared every time the integrated value reaches a predetermined number.

The predetermined number at which the integrated value of the second master pulse signals is cleared is predetermined on the basis of the ratio of the revolutions of the driven part and the encoder 6. When the encoder 6 makes four turns while the driven part makes one turn, the predetermined number is "4," and when the encoder 6 makes one turn while the driven part makes one turn, the predetermined number is "1." That is, the phase setting section 16 does not necessarily have to count the second master pulse signals in the latter case.

The integrated values by the speed setting section 15 and the phase setting section 16 are sent as control messages to the slave control section 3, which is included in the control range, from the master network connecting section 17 via the network line at predetermined periods, or every 100 microseconds, for example.

Figure 8:
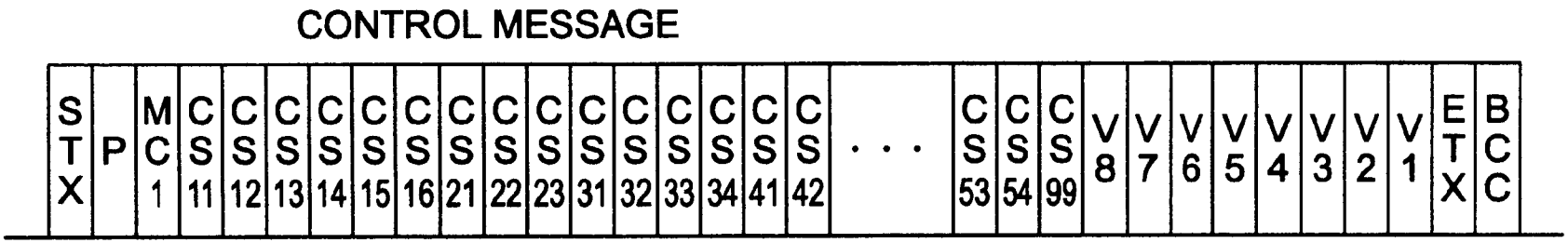
FIG. 8 is a diagram illustrating a printing operation control message transmitted by the master control section.

The control message comprises a text having a control code "P" indicating that the message is a drive reference, "MC 1" representing the master control section, node numbers "CS11" through "CS16," "CS21" through "CS23," "CS31" through "CS34," "CS41" through "CS48," "CS51" through "CS54," and "CS99" of #11~#16, #21~#23, #31~#34, #41~#48, #51~#54, and #99 of the slave control section 3, representing printing couples of the printing units CT1, CT2, CT3, CT4, and CT5 that are included in the control range, and the folding unit FD, "V8" through "V5" representing the drive reference speed, and "V4" through "V1" representing the drive reference phase inserted between the start code "STX" and the end code "ETX", with a block check "BCC" attached to the text, as shown in FIG. 8, for example. "V8" through "V1" use "0" through "9" and "A" through "F" of ASCII codes, and both the drive reference speed and the drive reference phase comprise 4 bytes, for example, in the message shown.

These messages are transmitted to the network line 5 at a rate of 20 megabits per second, for example.

Upon receipt of the control message, each slave control section 3 sends a drive reference speed to the drive reference speed signal output section 32, and a drive reference phase to the corrected drive reference phase signal output section 33 for further processing.

That is, the drive reference speed signal output section 32, into which the drive reference speed is entered, calculates the following equation to obtain a value S1 proportional to the speed value set by the processing section 12, and generates an analog signal corresponding to S1 as a drive reference speed signal.

$$S1=(Y2-Y1)/T$$

where Y2 is the drive reference speed that has just been entered to the drive reference speed signal output section 32; Y1 is the drive reference speed that was entered immediately before Y2; and T is a predetermined time interval in which the master control section 1 sends the control message.

When the integrated value of the first master pulse signals in the speed setting section 15 is reset by the second master pulse signal, it may happen that Y1>Y2, and as a result, S1<0. In such a case, S1 can be obtained by calculating the following equation.

$$S1=(Ym+Y2-Y1)/T$$

where Ym is the number of the first master pulses needed for the second master pulse signals to be generated, and it is a predetermined value.

The corrected drive reference phase signal output section 33, into which the drive reference phase has been entered, receives the phase correction value registered in the phase correction value output section 42 every time a drive reference phase is entered, obtains a corrected drive reference phase by adding the drive reference phase to the phase corrected value, replaces the previous corrected drive reference phase with a newly corrected drive reference phase that has just been entered, and generates the latest drive reference phase in the form of an appropriate signal.

Aside from this, an output pulse signal of the encoder 6 connected to the driving means M corresponding to each slave control section 3 is entered into the feedback signal receiving section 38, and the output pulse signal of the encoder 6 sent to the feedback signal receiving section 38 is processed in the feedback phase signal output section 37 and the feedback speed signal output section 39.

The feedback phase signal output section 37 adds up the pulse signals generated by the encoder 6 and the Z-phase pulse signal, and outputs the integrated value as a rotating phase signal for the driving section in the form of an appropriate signal. In the integrating operation carried out by the feedback phase signal output section 37, the integrated value of pulse signals is cleared by the Z-phase pulse signal, while the integrated value of Z-phase pulse signals is cleared every time the integrated value reaches a predetermined number. The predetermined number at which the integrated value is cleared is determined in advance on the basis of the ratio of the revolution of the driven part and the revolution of the encoder 6, as in the case where the integrated value of the second master pulse signals in the phase setting section 16 is cleared.

The feedback speed signal output section 39 adds up the pulse signals produced by the encoder 6, and every time the slave network connecting section 31 receives a control message, obtains a value S2 proportional to the rotating speed of the driving means M by calculating $$S2=(Y4-Y3)/T$$

where Y4 is the integrated value at that time, Y3 is the integrated value at the time when the immediately preceding message was received, and T is a predetermined time interval for the master control section 1 to send the control message. The feedback speed signal output section 39 then produces an analog signal corresponding to this value S2 as a drive speed signal. When the integrated value of pulse signals in the feedback speed signal output section 39 is reset by the Z-phase pulse signal, it may happen that Y3>Y4, and accordingly S2<0. In such a case, S2 can be obtained by calculating $$S2=(Yn+Y4-Y3)/T.$$

where Yn is the number of pulse outputs produced by the encoder 6 within the time interval where two preceding and succeeding Z-phase pulse signals are produced, which is the same number as the number of outputs of the first master pulse signals needed for outputting the second master pulse signal, and it is a predetermined value.

In the slave control section 3, moreover, the drive power sent from the motor driver 41 to the driving means M is corrected every time the slave network connecting section 31 receives a control message. The details are as follows.

Every time the slave network connecting section 31 receives the aforementioned control message, the corrected drive reference phase signal output section 33 produces a corrected drive reference phase signal, as described above. This corrected drive reference phase signal is entered into the phase difference detecting section 34 where the rotating phase value of the driven part produced by the feedback phase signal output section 37 has been entered in advance.

The phase difference detecting section 34 therefore obtains a difference between the corrected drive reference phase and the rotating phase of the driven part from the corrected drive reference phase signal and the feedback phase signal every time a corrected drive reference phase signal is entered, and outputs the difference thus obtained to the phase difference signal output section 35 which is an integrating amplifier. This allows the phase difference signal output section 35 to produce as a phase difference signal an analog signal corresponding to the difference entered.

The aforementioned drive reference speed signal is corrected by the phase difference signal into a first corrected speed signal in the first speed signal correcting section 36, and also corrected by the drive speed signal into a second corrected speed signal in the second speed signal correcting section 40. This second corrected speed signal is entered into the motor driver 41.

Upon receipt of the second corrected speed signal, the motor driver 41 corrects the drive power to be fed to the driving means M so as to make it consistent with the second corrected speed signal.

With the aforementioned control, the rotating phases of the driven parts in the control range of the master control section 1 are adjusted so as to maintain a predetermined relationship with respect to the rotating phase of the folding cylinder FC of the folding unit FD, corresponding to their respective web paths, and put into synchronous operation in which their revised speeds agree with each other.

As described above, the present invention makes it possible to prevent the position at which a paper web printed by a printing unit is cut by a folding unit from overlapping the printed image on the paper web, and thus eliminate the mismatching of the printed image and the paper web cutting position in a rotary press driven by an independent drive means of each unit. The present invention also makes it possible to save space by eliminating adjust roller devices from a plurality of web paths running from printing units through the folding unit, and simplify paper web paths, leading to easy maintenance.

Elimination of the adjust roller devices helps reduce unwanted tensions on a traveling paper web, making web traveling stable. This leads to reduced spoilage due to wrinkles and improper paper folding. Furthermore, reduced web path length helps reduce spoilage at the start and end of printing, and when changing paper webs.

What is claimed is:

1. A synchronous control system for rotary presses comprising a master control section for controlling the entire system, drive means provided on a plurality of printing units and a folding unit that cuts and folds a printed paper web into printed images for independently driving the printing and folding units, and control sections for controlling the drive means for each unit; at least one printing unit having a plurality of web paths running from the printing unit in question to the folding unit, and printing being carried out by passing the paper web through any of the web paths: the improvement comprising the printing unit control section having a plurality of web paths comprising a drive reference receiving section for receiving a drive reference from the master control section, a phase correction value output section for generating a phase correction value proportional to the residual length obtained by dividing the length of a selected web path from the printing unit in question to the folding unit with the outer periphery length of the printing cylinder of the printing unit in question, a drive reference speed signal output section for generating a signal relating to a drive reference speed based on the drive reference received by the drive reference receiving section, a corrected drive reference phase signal output section for generating a signal relating to a corrected drive reference phase obtained by correcting with the phase correction value the drive reference phase based on the drive reference received by the drive reference receiving section, a feedback signal receiving section for receiving a feedback signal on the operating state of the printing unit in question, a feedback speed signal output section for generating a signal relating to a feedback speed based on the feedback signal received by the feedback signal receiving section, a feedback phase signal output section for generating a signal relating to a feedback phase based on the feedback signal received by the feedback signal receiving section, a phase difference detecting section for detecting a phase difference between a corrected drive reference phase and the feedback phase from the corrected drive reference phase signal and the feedback phase signal, a phase difference signal output section for generating a signal relating to a phase difference detected by the phase difference detecting section, and a signal correcting section for correcting a phase difference signal relating to a phase difference between the corrected drive reference phase and the feedback phase and the drive reference speed signal based on the feedback speed signal, and generating a corrected control signal; the drive means of the printing unit in question being controlled by the corrected control signal generated by the signal correcting section via a motor driver.

2. A synchronous control system for rotary presses as set forth in claim 1 wherein the printing units have a plurality of driven parts; each driven part having drive means and a control section for controlling the drive means of each driven part.

3. A synchronous control system for rotary presses as set forth in claim 1 wherein each of the printing units has at least one of the web paths running from the printing unit in question to the folding unit without passing through a bay window device, and at least one of the web paths running from any of a plurality of turn bars to the folding unit via the bay window devices.

4. A synchronous control system for rotary presses as set forth in claim 1 wherein the printing unit control section is a slave control section subordinated to the master control section; the master control section being adapted to transmit drive references, including drive reference speed and drive reference phase.

5. A synchronous control system for rotary presses as set forth in claim 4 wherein the master control section and the slave control section are connected to each other with network lines.

6. A synchronous control system for rotary presses as set forth in claim 5 wherein the network lines are formed in a loop.

7. A synchronous control system for rotary presses as set forth in claim 4 wherein the master control section has an input operation section for entering information required for operating the rotary presses, a processing section for causing other component sections to operate by processing information entered from the input operation section and controlling the transmission and receiving of signals to and from the slave control section for storing values cor correcting the phases of the driven parts of the printing units in relation to the length of each web path running from the printing units to the folding unit, and a drive reference setting section for setting drive reference phase and drive reference speed.

8. A synchronous control system for rotary presses as set forth in claim 7 wherein the input operation section is capable of performing input processing to store in the memory section the length values of web paths running from the printing units to the folding unit.

9. A synchronous control system for rotary presses as set forth in claim 7 wherein the processing section prepares a control range designating message by organizing sets of rotary presses, reads from the memory section the values required for correcting the phases of the printing unit driven parts in relation to the lengths of web paths running from the printing unit to the folding unit, and prepares a control message base on the values.

10. A synchronous control system for rotary presses as set forth in claim 9 wherein the control range designating message is a text comprising a text in which "F" indicating that the message designates the control range, "MCI" representing a master control section, "CS numbers" representing the node numbers of the slave control sections for printing couples that are the control range in question are inserted between the start code "STX" and the end code "ETV of the message, with a block check "BCC" attached to the text.

11. A synchronous control system for rotary presses as set forth in claim 9 wherein the control message is a text comprising "G" indicating that the message is a phase correction value, "MCI" representing the master control section, "CS numbers" representing the destinations, "V numbers" representing the phase correction values are inserted between the start code "STX" and the end code "ETV of the message, with a block check "BCC" attached to the text.

12. A synchronous control system for rotary presses as set forth in claim 4 wherein the slave control section has a slave network connecting section that also serves as a drive reference receiving section.

13. A synchronous control system for rotary presses as set forth in claim 12 wherein the slave network connecting section is a microcomputer including an interface that receives via a network line a control range designating message comprising set organization information transmitted by the master control section, and control messages, such as drive references including drive reference speed and drive reference phase, phase correction values for correcting the rotating phase of the printing cylinder, etc., and transmits to the master control section via the network line response messages acknowledging the receipt of the message from the master control section as necessary.

14. A synchronous control system for rotary presses as set forth in claim 4 wherein upon receipt of a control range designating message from the master control section, the slave control section returns a response message to the master control section.

15. A synchronous control system for rotary presses as set forth in claim 14 wherein the response message comprises "ACK" indicating a response message, and an own node number indicating the slave control section that responded.

16. A synchronous control system for rotary presses as set forth in claim 7 wherein the drive reference setting section comprises a master pulse signal output section for generating a first master pulse signal, and a second master pulse signal every time a predetermined number of the first master pulse signals are generated, a speed setting section for setting a drive reference speed on the basis of the first master pulse signal, and a phase setting section for setting a drive reference phase based on the first and second master pulse signals.

17. A synchronous control system for rotary presses as set forth in claim 1 wherein a plurality of the master control sections are provided; each master control section being connected to the slave control section with network lines, so that processing can be performed by selectively changing a plurality of the master control sections.

18. A synchronous control system for rotary presses as set forth in claim 2 wherein the printing unit control section is a slave control section subordinated to the master control section; the master control section being adapted to transmit drive references, including drive reference speed and drive reference phase.

19. A synchronous control system for rotary presses as set forth in claim 5 wherein the master control section has an input operation section for entering information required for operating the rotary presses, a processing section for causing other component sections to operate by processing information entered from the input operation section and controlling the transmission and receiving of signals to and from the slave control section for storing values cor correcting the phases of the driven parts of the printing units in relation to the length of each web path running from the printing units to the folding unit, and a drive reference setting section for setting drive reference phase and drive reference speed.

20. A synchronous control method for rotary presses comprising a master control section for controlling the entire system, drive means provided on a plurality of printing units and a folding unit that cuts and folds a printed paper web into printed images for independently driving the printing and folding units, and control sections for controlling the drive means for each unit; at least one printing unit having a plurality of web paths running from the printing unit in question to the folding unit, and printing being carried out by passing the paper web through any of the web paths: the improvement comprising a method for controlling the printing unit control section having a plurality of web paths comprising steps of selecting a web path and establishing a phase correction value proportional to the residual length obtained by dividing the length of the selected web path running from the printing unit in question to the folding unit by the outer periphery length of the printing cylinder of the printing unit, corresponding to the selected web path, obtaining a drive reference speed and a drive reference phase on the basis of a drive reference transmitted from the master control section, obtaining a corrected drive reference phase by correcting the drive reference phase with the phase correction value, obtaining a feedback speed and a feedback phase from a feedback signal on the printing unit, obtaining a phase difference between the corrected drive reference phase and the feedback phase, and generating a corrected control signal by correcting the drive reference speed based on the drive reference with the phase difference between the corrected drive reference phase and the feedback phase and the feedback speed, so that the driving of the printing unit can be controlled with this corrected control signal.

* * * * *